United States Patent [19]

Shindo et al.

[11] 3,950,930

[45] Apr. 20, 1976

[54] FALSE TWISTING DEVICE

[75] Inventors: Noboru Shindo, Maikata; Hiroshi Hashizume, Kyoto; Shuichi Kikuchi, Nagaokakyo, all of Japan

[73] Assignee: Murata Kikai Kabushiki Kaisha, Kyoto, Japan

[22] Filed: Aug. 6, 1974

[21] Appl. No.: 495,113

[30] Foreign Application Priority Data

Aug. 10, 1973 Japan ..... 48-90163

[52] U.S. Cl. ..... 57/77.45

[51] Int. Cl.[2] ..... D01H 7/92; D02G 1/04

[58] Field of Search ..... 57/34 R, 77.3, 77.45, 57/92–94

[56] References Cited

UNITED STATES PATENTS 3,662,531 5/1972 Carroll ..... 57/77.45 X 3,759,025 9/1973 Takai et al. ..... 57/77.45 X

*Primary Examiner*—Donald E. Watkins

*Attorney, Agent, or Firm*—Whittemore, Hulbert & Belknap

[57] ABSTRACT

The present invention relates to a false twisting device comprising false twisting spindles including a turbine provided with turbine blades capable of rotating by employing of fluid and controlling device for the rotation number of the turbine. The control of the rotation number can be performed by using a rotation number detector, a rotation number prescribing device, a controller for controlling the rotation number of each turbine through a sevo valve and a scanner.

1 Claim, 6 Drawing Figures

FALSE TWISTING DEVICE

BACKGROUND OF THE INVENTION

Higher quality has recently been required of crimped yarns, and therefore, in the spindle type false-twisting processing method most frequently adopted for the manufacture of crimped yarns, it is necessary to perform investigations and controls on the so-called three T conditions, namely the twisting tension, the heating temperature and the twist number. Among these conditions, the tension and temperature can be controlled relatively easily, but control of the twist number is very difficult. For example, in the case of a friction-driving type false twisting spindle, the rotation number is periodically investigated and amended so that the deviation of the rotation number is within a range of ± 1% prescribed rotation number. However, the control of the rotation number is very difficult owing to such troubles as sticking of oiling agents and dirts on the friction-driving portion, abrasion of said portion and elongation of a driving belt. For this reason, we adopted a fluid turbine-type false twisting spindle instead of the above friction-driving type false twisting spindle. However, also in this case, it was difficult to maintain a prescribed rotation number uniformly among a number of spindle units for a long time, because of the deviation of the processing precision in turbines and variation of the air pressure. Accordingly, at the experimental stage, the rotation number was detected with respect to each unit and control of the rotation number was effected with respect to each unit. However, provision of a detecting and controlling device in each unit is very expensive, though the yarn quality is not damaged, and hence, this method is not suitable for the practical operation.

It is therefore a primary object of the present invention to provide a false twisting machine which can give processed yarns having good quality without increase of the equipment cost.

DETAILED DESCRIPTION OF THE INVENTION

Figure 1:
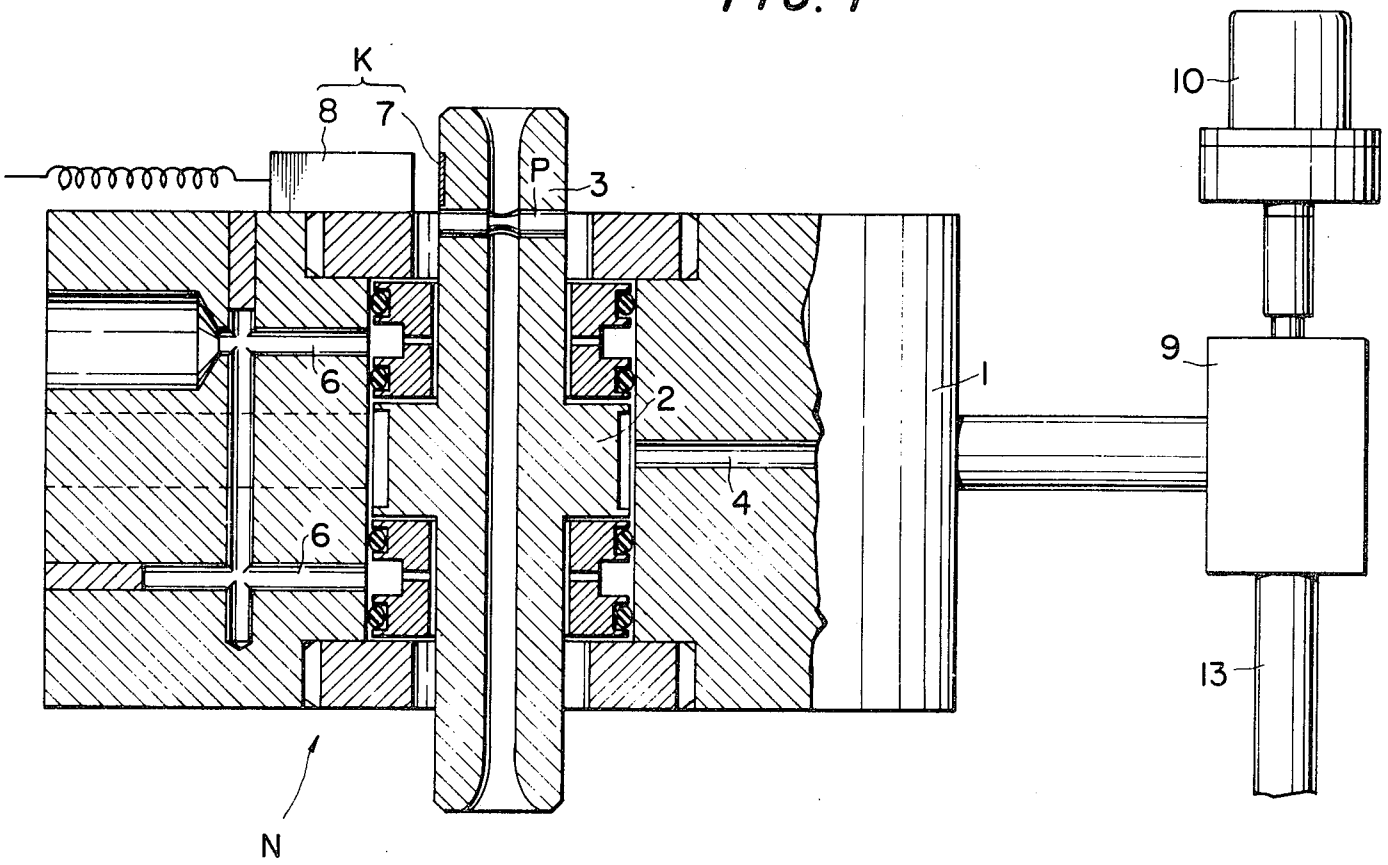
FIG. 1 is a front view partly in section of a false twisting spindle unit of the present invention.
Figure 2:
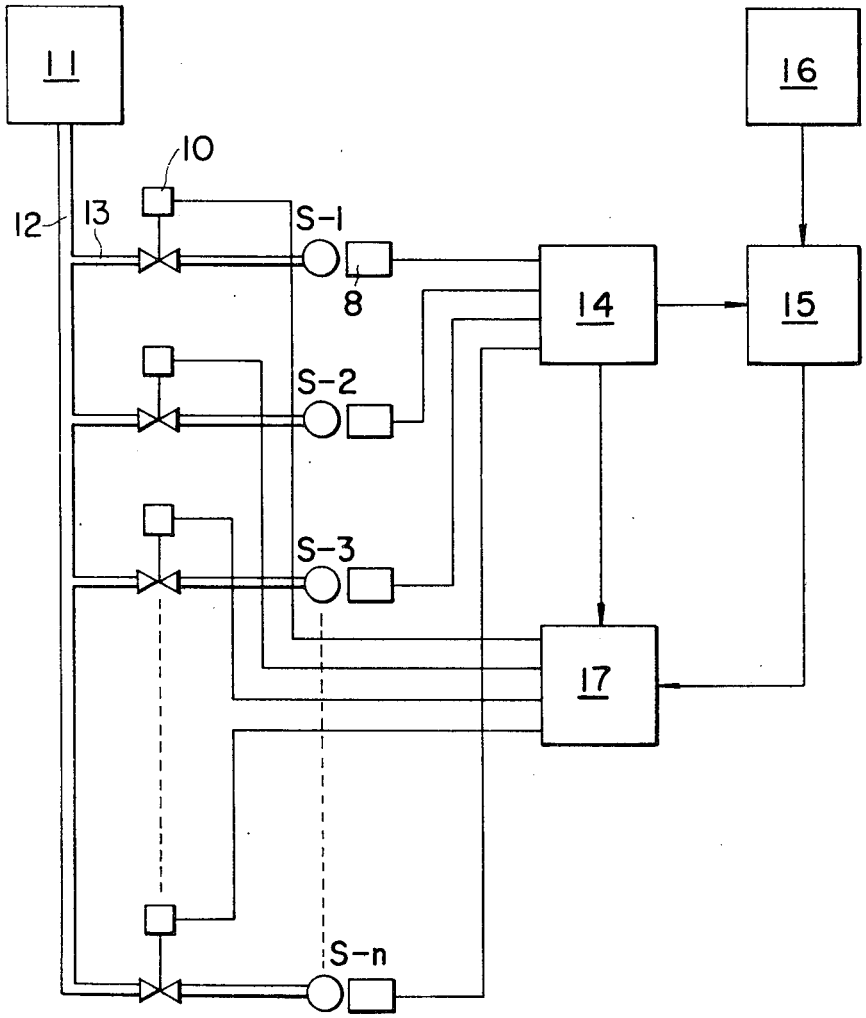
FIG. 2 is a schematic diagram of showing the false twisting device of the present invention.
Figure 3:
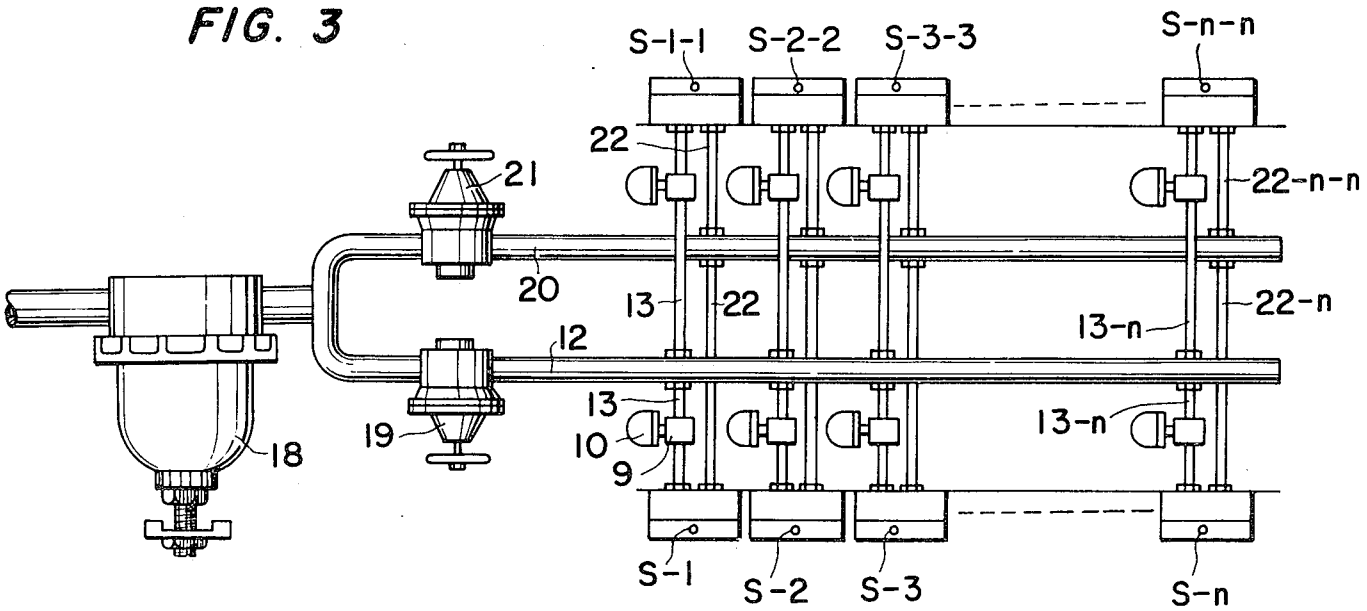
FIG. 3 is a plan view showing the piping system for fluid.

The present invention will now be described by reference to the accompanying drawing. By referring to FIG. 1, in a hollow hole of a housing 1, a turbine 3 having turbine blades 2 and including a twister pin P installed in a shaft hole is rotated by a fluid fed from a rotation fluid feed passage 4, and the turbine 3 is supported rotatably by a fluid fed from a bearing fluid feed passage 6. A false twisting spindle N having the above structure is employed. The rotation number of the turbine of false twisting spindle is detected as a signal of the turbine megnatized by a magnet 7 by a spindle rotation number detector K including a sensor 8 having a coil, and the rotation number is controlled by a servo valve 9 mounted in the rotation fluid passage and operated by a servo motor 10. A number of such false twisting spindle units S as shown in FIG. 1 are provided as shown in FIGS. 2 and 3. A fluid to be fed to each of spindle units (S-1) to (S-n) is supplied from a fluid feed source 11 and introduced from a branched tube 13 through an air filter 18, a pressure-reducing valve 19 and a fluid feed main tube 12. A bearing fluid is fed from a branched tube 22 of a main tube 20 having a pressure-reducing valve 21. A sensor 8 and a servo motor 10 of each false twisting spindle are connected to one scanner 14. This scanner 14 connects, in order, a comparator 15 connected to a prescribing device 16, sensors 8 of spindle units (S-1) to (S-n) and the servo motor 10. Signals detected by sensors of these connected spindle units are introduced into the comparator 15 with the prescribed value set by the prescribing device. When there is a deviation, an indication signal is transmitted to the servo meter 10 through a controller 17, whereby the rotation number is controlled.

This control using the scanner can be performed by the following methods.

Figure 4:
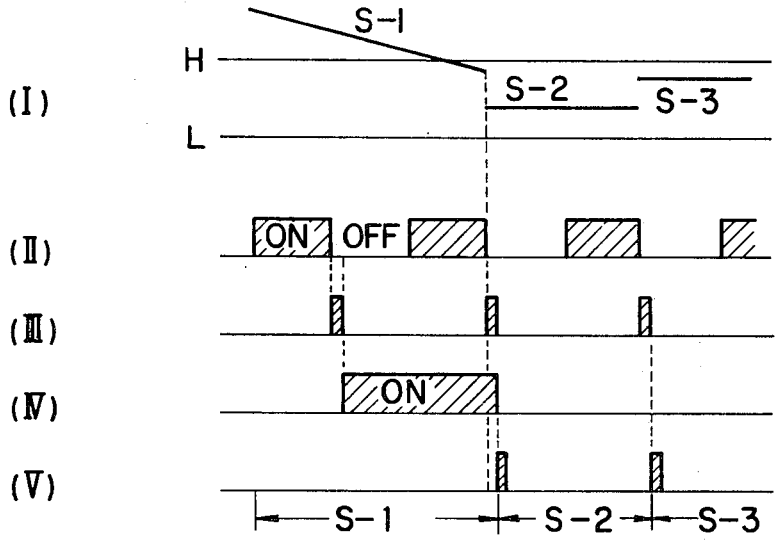
FIGS. 4, 5 and 6 are diagrams illustrating examples of the control method using a scanner.
Figure 5:
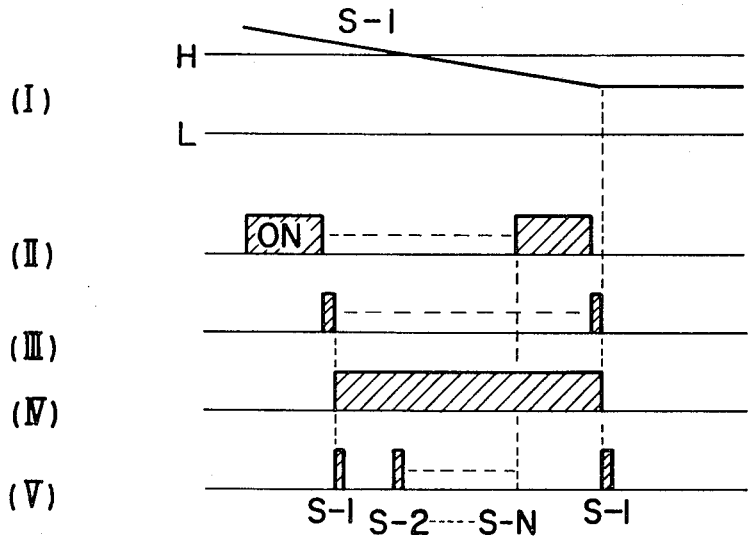
Figure 6:
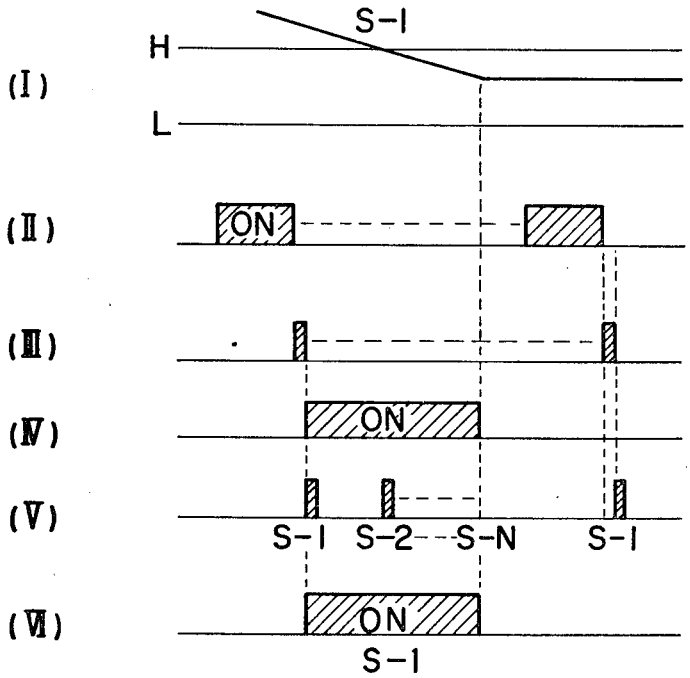

Referring now to FIGS. 4 to 6 which are diagrams illustrating examples of the control method using a scanner, wherein reference characters I to VI designate as follows respectively:

I . . . rotation number
II . . . detection by a rotation number detector
III . . . comparison with the prescribed value set by the prescribing device
VI . . . driving of the servo valve
V . . . signal of charge-over
VI . . . timer for driving the servo valve A method which is effective when the variation of the rotation is small is shown FIG. 4. In each of false twisting spindle units S provided in the false twisting machine the rotation number is detected and it is compared with the prescribed value. If the rotation number is within an allowable range, scanning is effected in the next spindle unit. When the detected rotation number is outside an allowable range of the prescribed value, scanning is stopped at this spindle unit and the rotation number is controlled. When the rotation number is thus adjusted within the allowable range, scanning is conducted in the next spindle unit. More specifically, in FIG. 4, the rotation number of the false twisting spindle (S-1) is outside the allowable deviation range of the prescribed value (H-L). In this case, the rotation number is detected at constant intervals by a rotation meter, and while the rotation meter is turned off, the detected rotation number is memorized. When the rotation meter is turned off, the memorized rotation number is compared with the prescribed rotation number, and the servo valve is driven in response to the comparison signal. In case it is judged that the rotation number is outside the allowable range of the prescribed value, no change-over signal is given to the scanner. When the rotation meter is then turned on, since the spindle rotation number has already been within the allowable range of the prescribed value (H-L), even on comparison driving of the servo valve is stopped, and a signal of change-over to the next false spindle unit (S-2) is changed to the scanner. In the next unit (S-2), the detected value is within the allowable range of the prescribed value (H-L), driving of the servo valve is not effected and a signal of change-over to the next false twisting spindle unit (S-3) is given to the scanner.

A method which is effective when the variation of the rotation number is relatively frequently caused is shown in FIG. 5. In this method, the scanning is not stopped even when the detected value is outside the range of the prescribed value, and it performs scanning of the next unit. The servo motor as the control means is kept in the "on" state. After completion of scanning of the total units, the detection and comparison are effected again, and if the detected value is within the allowable range of the prescribed value, the servo motor is turned off. The spindle rotation number detection is continuously effected by the rotation meter while it is successively turned on and off. When it is judged that the rotation number of the false twisting spindle unit (S-1) is outside the allowable range of the prescribed value, the servo motor is kept in the continuous operation state and signals are given to the scanner so that it makes a circuit of (S-1) to (S-n). When the scanner returns to (S-1), the rotation number is detected again. If this method is adopted, the scanning time can be reduced to an order of milliseconds even in the case of a known apparatus.

Another control method is shown in FIG. 6. In this method, scanning is always performed without interruption. When a value outside the prescribed value range is detected, the servo motor is turned on for a certain period by means of a timer. More specifically, detection by the rotation timer and comparison are continuously conducted, and on detection of a deviated rotation number in the false twisting spindle unit (S-1), the servo valve-driving timer is turned on, so that the servo valve is driven for a certain time prescribed by the timer, and it is then turned off by the timer. Signals are given to the scanner so that it makes a circuit of (S-1) to (S-n), and when the scanner returns to the spindle unit (S-1) after the circuit, the rotation number is detected again. If the detected value is outside the prescribed value range, the servo motor is driven by the timer again. In contrast, if the detected value is within the prescribed value range, no signal is given to drive the servo motor.

Control using the scanner can be accomplished by any of the foregoing methods, and other modifications can be adopted conveniently. In this invention, good results can be obtained by using only one controlling mechanism including very expensive prescribing device and comparator. It is desired that one of this control mechanism is provided for at least one false twisting machine, and several false twisting machines or all of twisting machines in one factory can be controlled by employing one of this controlling mechanism. Accordingly, this invention attains great industrial advantages.

What is claimed is:

1. A false twisting device comprising a plurality of false twisting spindles each including a turbine, said turbines being rotatable in response to a fluid passing therethrough, said turbine having a hollow shaft and the false twisting spindle including a twister pin mounted in said hollow shaft extending transversely thereof, a turbine rotation number detector operably associated with each false twisting spindle turbine for detecting turbine rotation and providing electrical pulses corresponding to the speed of rotation of the associated turbine, a rotation number prescribing device for prescribing the speed of the turbines in terms of a rotation number, a scanner for scanning the rotation number detectors associated with the false twisting spindles separately, a comparator for receiving the signals from the rotation number prescribing device and the turbine rotation number detectors and comparing the information from the rotation number prescribing device and the individual turbine number detectors separately, a controller connected to the scanner and comparator for providing an output signal in response to differences in the signals compared in the comparator, and a servo valve connected to each of the false twisting spindles responsive to the controller for varying the fluid passed to the particular false twisting spindle associated therewith in response to signals from the controller for regulating the fluid to the false twisting spindle to regulate the speed of the spindle in accordance with the rotation number prescribing device whereby the spindles are caused to rotate at a speed determined by the rotation number prescribing device.

* * * * *